United States Patent [19]

Takagi

[11] 4,036,136

[45] July 19, 1977

[54] CORONA PRODUCING A PLANOGRAPHIC PRINTING SHEET

[75] Inventor: Tohru Takagi, Hiratsuka, Japan

[73] Assignee: Kansai Paint Co., Ltd., Japan

[21] Appl. No.: 558,300

[22] Filed: Mar. 14, 1975

[30] Foreign Application Priority Data

Mar. 18, 1974 United Kingdom ..... 49-4929966

[51] Int. Cl.[2] ..... H01T 19/00

[52] U.S. Cl. ..... 101/467; 101/426; 101/DIG. 13; 204/165; 250/324; 427/40; 361/228

[58] Field of Search ..... 101/467, 426, DIG. 13; 204/165; 250/324; 317/262 A; 427/40

[56] References Cited

U.S. PATENT DOCUMENTS

| | | | |
|---|---|---|---|
| 2,879,396 | 3/1959 | McDonald | 317/262 A |
| 2,910,723 | 11/1959 | Traver | 101/426 X |
| 2,935,418 | 5/1960 | Berthold et al. | 101/426 X |
| 3,081,165 | 3/1963 | Ebert | 101/DIG. 13 |
| 3,244,546 | 4/1966 | Cranch | 101/DIG. 13 |
| 3,662,169 | 5/1972 | Sorensen et al. | 317/262 A |

*Primary Examiner*—Clyde I. Coughenour

*Attorney, Agent, or Firm*—Ostrolenk, Faber, Gerb & Soffen

[57] ABSTRACT

A method for producing a plate or sheet useful in planographic printing which is characterized in that the surface of an oleophilic body comprising oleophilic resin is subjected to a corona discharge treatment to form a hydrophilic layer on said surface, and that said method can be carried out without difficulty at a low cost and the reproducibility of the printing plate thereby produced is excellent.

2 Claims, No Drawings

CORONA PRODUCING A PLANOGRAPHIC PRINTING SHEET

BACKGROUND OF THE INVENTION

This invention relates to a method for producing a plate or sheet useful in planographic (lithographic) printing. More particularly, the invention relates to a method for producing a plate or sheet useful in planographic printing which comprises an oleophilic body having a hydrophilic layer formed on the surface.

In the conventional art of planographic printing, particularly in the art of offset printing such as for easy business-use, an offset master sheet of low quality prepared by the electrostatic plate making method is well known. Fro example, a photoconductive layer formed and electrostatically charged on a non-electroconductive substrate is exposed to light for desensitizing of the non-image area and forming a latent image to which an oleophilic material is applied and forms printing elements on the image area by electrostatic force; thus an offset master sheet is obtained.

In the above electro-static plate making method, however, the steps of development and fixing are necessary after the formation of latent image by light exposure, and therefore it is not so convenient. Further, the oleophilic material (the so-called toner) cannot be applied with sufficient selectivity and fineness to the surface of the substrate, so that the resolving power of images is inferior in precise printing.

In consideration of the above-mentioned planographic printing plate, especially of the master sheet for business-use offset printing machines, the inventor has proposed a new printing materal which is low in cost, easy in plate making and good in resolving power of printing images. The plate or sheet useful in planographic printing is made by chemically treating the surface of an oleophilic body comprising oleophilic resin to from a hydrophilic layer on the surface (Japanese patent application No. 113,513 of 1972). For all the excellent properties of this material in practical uses, it is disadvantageous that strong oxidizing agents must be employed in the chemical treatment process. That is, it is very troublesome to take charge of the treating agents without the loss of their effect and to treat the waste of used treating agents.

SUMMARY OF THE INVENTION

It is, therefore, the object of the present invention is to provide an improved method for producing a plate or sheet useful in planographic printing which is free from the above-mentioned disadvantages.

Another object of the invention is to provide a method for producing a plate or sheet useful in planographic printing in which chemical treating agents are not used for forming the hydrophilic layer on the surface of the oleophilic body.

Still other object of the invention is to provide a method for producing a plate or sheet useful in planographic printing which is low in cost, easy to make and is excellent in resolving power of printing images.

Pursuant to the above objects, the inventor of the present invention has carried out extensive studies on the method for producing a plate or sheet useful in planographic printing, and as the result, the method of this invention has been accomplished. According to the invention, the method for producing a plate or sheet useful in planographic printing is characterized in that an oleophilic body comprising an oleophilic resin is applied with corona dischage to form a hydrophilic layer on the surface of said oleophilic body.

DETAILED DESCRIPTION OF THE INVENTION

As the oleophilic resins which can be used for the method of the present invention, there are various resins which have sufficient oil-sensitivity (oil-affinity) to planographic printing inks and the surface of which can be easily converted to form a hydrophilic layer by corona discharge treatment. As the oleophilic resin, either an addition polymer or a polycondensate is used. Typical examples of the addition polymers are, for example, polymers or copolymers of olefins such as 1,3-butadiene, isoprene, isobutylene, propylene and ethylene, halogenated olefins such as chloroprene, vinyl chloride and vinylidene chloride, aromatic vinyl compounds such as styrene and vinyl toluene, acrylic esters such as propyl acryltes, butyl acrylates and cyclohexyl acrylate, methacrylic esters such as ethyl methacrylate, butyl methacrylates and lauryl methacrylate, vinyl esters such as vinyl acetate and vinyl propionate, vinyl ethers such as butyl vinyl ethers, allyl esters such as diallyl phthalate, unsaturated nitriles such as acrylonitrile and unsaturated amides such as acrylamide, and natural addition polymers such as natural rubber and gutta-percha. As the polycondensate, there are, for example, polyesters, polyamides, oil-soluble phenol-formaldehyde resins and epoxy resins such as bisphenol A type epoxy resins. Also compounded resins of the aboves such as ABS (acrylonitrile-butadiene-styrene) resin may also be used.

Among all of them, natural rubber and the polymers and copolymers of diene compounds or halogenated diene compound such as 1,3-butadiene, isoprene and chloroprene are preferable since their surface can be converted with paticular ease to form the hydrophilic layer because of the ethylenically unsaturated bonds remaining in their molecules.

Further, pigments, fillers, curing agents, plasticizers and dyestuffs can be added and dispersed to the above-mentioned oleiphilic resins to the extent that the oleophilic properties of resins is still retained. When the oleophilic resin is made electroconductive or semi-electroconductive by the addition of electroconductive or semi-electroconductive fillers, the plate or sheet useful in planographic printing thus obtained can be subjected to electrical treatment by, for example, a facsimile apparatus in order to make a planographic printing plate or sheet. In the electrical treatment for making of printing plates or sheet, the hydrophilic layer is selectively destroyed so that the oleophilic body is exposed to form the image area. As the fillers contained in the oleophilic body for the purpose of the electrical image forming, there are, for example, carbonaceous materials such as carbon black and graphite, metallic powders such as copper powder, silver powder and stainless steel powder, and metallic compound semiconductors such as zinc oxide or titanium dioxide doped with impurity element. Generally, 40 to 200 parts by weight of these fillers are added to 100 parts by weight of the oleophilic resins in order that the specific volume resistivity is made 10 to $10^8$ ohm cm, preferably $10^2$ to $10^6$ ohm cm. When the specific volume resistivity of the oeophilic body exceeds $10^8$ ohm cm, the plate or sheet ultimately obtained is not suitable for the plate making process by electrical method. On rhe other hand, when the resistivity does not reach 10 ohm cm, the aplying of the electrical method for plate making is also difficult.

When the oleophilic resin is used for producing a plate or sheet useful in planographic printing according to the present invention, the resin is shaped into sheet-like forms. In order to form a sheet of the oleophilic resin, either the extrusion method or more commonly the coating method is employed. In the former method, the oleophilic resin is heated to soften it or to melt it and extruded in a form of a sheet. In the latter method, a solution or a disperson made of the oleophilic resin and a suitable solvent, a dipersion medium or a polymerizable viny monomer is applied to the surface of a substrate in a sheet form, or powder of the oleophilic resin is laid on a substrate, and according to necessity, it is further cured, for example, by heating to form a coating film, the oleophilic body of the plate or sheet useful in planographic printing is thus obtained. The below-mentioned treatment of corona discharge gives the effect of promoting the formation of cross linkages between polymer molecules, so that the above curing is not necessarily brought to perfection as in other purposes.

As the above-mentioned substrates, for example, paper, plastic sheets and metallic sheets can be used. When a plate or sheet useful in planographic printing to be used for the electrical plate making method is produced, the surface of the substrate such as paper or plastic sheet is previously provided with vacuum deposition coating or a laminating of foil, of metal such as aluminum, or one side surface of the oleophilic resin sheet is provided with a vacuum deposition coating of metal and thus the rear side of the oleophilic body is made electroconductive by the formation of the electroconductive layer. The thickness of the oleophilic body in layer form may be generally 5 to 300 microns, when the oleophilic resin is overlayed or sprayed, the thickness of the body layer is preferably 8 to 40 microns, and when it is formed into a sheet without using a substrate, the thickness is preferably 50 to 200 microns. A body layer of the oleophilic body may also be reinforced afterwards by laminating a support member in a sheet form as a substrate.

In order to form a hydrophilic layer on the surface of the oleophilic body, a corona by electric discharge is applied thereto. For the corona discharge treatment, for example, a well known corona discharge device can be used, and a brush corona is usually prefered. The discharge current applied in the treatment is generally not less than 0.05 milliwatt-hour, preferably not less than 0.2 milliwatt-hour, per 1 $cm^2$ surface area of the oleophilic body. When the discharge current is less than 0.05 milliwatt-hour per $cm^2$, the surface of the oleophilic body cannot be rendered hydrophilic sufficiently. The atmosphere around the surface of oleophilic body is not restricted but the discharge is carried out in air usually.

The degree of the discharge treatment is measured by the wettability of the surface of the oleophilic body with an aqueous test solution for surface tension, and a spot of test solution spreads spontaneously on the surface immediately after being brought into contact and is left as it is, when a test solution having more than 50 dynes/cm, preferably 60 dynes/cm of the surface tension is used. If the surface of the oleophilic body has no wettability against an aqueous test solution having more than 50 dynes/cm of surface tension, the material thus treated cannot be used for planographic printing.

In the method of making plate for the planographic printing using the plate or sheet of the present invention, the plate or sheet is engraved by selective destroying of the hydrophilic layer on the image area to expose the oleophilic body portions. The method of the destroying is not restricted specifically, and any of the methods such as a mechanical, thermal or electrical method is employed. For example, in a mechanical method, a stylus as an ultrasonic vibration element which is kept in contact with the hydrophilic layer is scanned and ultrasonic vibrations are applied in the image areas. In the thermal method, for example, selective heating is effected by the contact of a thermo-pen or by irradiation with a laser beam with scanning. In the electrical method, the plate or sheet should have an electroconductive and oleophilic body which contains an electroconductive substance as a filler, and a facsimile apparatus is fitted with the printing plate or sheet. A stylus electrode is then contacted and scanned hereon, meanwhile the applied voltage is modulated according to the electrical signals for the printing images. Thus the hydrophilic layer in the image area is selectively destroyed by electric currents. Further, the selective destruction of the hydrophilic layer can be carried out by electric discharge usng a stylus electrode.

The plate or sheet useful in planographic printing according to the present invention can be produced very easily, nevertheless the planographic printing plate prepared therefrom shows an excellent durability and resolving power in the offset printing for easy business-use.

In order that those skilled in the art may better understand the present invention and the manner in which it may be practised, the following specific examples are given, which are intended as merely illustrative and in no way restrictive of the invention.

EXAMPLE 1

In the first place, 100 g of 1,4-addition polymer tupe polybutadiene (trademard: LCB-150; made by the Japanese Geon Co., Ltd.; number average molecular weight: 5,500) was added to 300 g of mineral spirit, and cobalt naphthenate (0.15 g as metallic cobalt) was further added to form a composition. Using this composition, a 40 micron thick resin layer was formed on one side surface of an aluminum plate of 0.15 mm in thickness, the solvent was then evaporated, and the layer was cured by heating at 170° to 180° C for 30 minutes; thus an oleophilic body was formed and an intermediate for the planographic printing sheet was obtained.

The surface of the resin layer of the oleophilic body was then subjected to corona discharge treatment to form a hydrophilic layer; thereby a sheet useful in planographic printing was made.

In the above corona discharge, an electrode of a copper rod of 50 cm length and a grounded counter electrode made of a steel roll covered with synthetic rubber and placed 4 mm away from the copper rod were used. The above intermediate was moved along this steel roll covered with synthetic rubber and placed 4 mm away from the copper rod were used. The above intermediate was moved along this steel roll at a rate of 5 m per minute, where a sinusoidal AC voltage of 3 kHz frequency, 15,000 volts was applied between both electrodes and discharged. The current required on the input side (the primary circuit) of the transformer (240 volts) was 1.8 amperes.

The sheet useful in planographic printing obtained through the above process was easily and uniformly wetted by a test solution of 65 dyne/cm surface tension at 20° C.

Moving this printing sheet at a rate of 30 cm/sec, a 4880 A laser beam converged to 2 microns in diameter was perpendicularly irradiated by using an argon laser device (output: 280 mW), and the hydrophilic layer was destroyed to expose the oleophilic body in several parallel straight lines, thus forming a printing plate. The printing sheet was then attached to a desk-type offset rotary press and a printing test was carried out by using wetting water containing 10% by weight of isopropyl alcohol. As the result, a revolving power of 20 lines/mm and a durability of 2000 prints were obtained.

EXAMPLE 2

One hundred g of the same polybutadiene as that used in Example 1 was dissolved in 500 g of mineral spirits, and 40 g of electroconductive carbon black (trademark: Corax L; made by Degussa Company, West Germany) was further added. This mixture was well dispersed by a shaker-type paint dispersing device, and cobalt naphthenate (0.1 g as metallic cobalt) was then added to obtain a composition.

This composition was applied on one side surface of an aluminum plate of 0.15 mm in thickness to form a coating of 10 microns in thickness. After evaporating the solvent, the coating was almost cured by heating at 170° to 180° C for 15 minutes from an oleophilic body and an intermediate for a sheet useful in planographic printing was obtained. The specific volume resistivity of the layer of the composition as the oleophilic body was about $2 \times 10^2$ ohm:cm.

The above intermediate was subjected to the corona discharge treatment by using a similar corona discharge device to that used in Example 1 except that the upper electrode was a coper rod insulated by quartz glass and the grounded counter electrode was an uncoated steel roll. The sheet useful in planographic printing was made by the corona discharge treatment with 3.6 amperes of the primary current. The thus formed surface layer was hydrophilic and easily wetting uniformly by pure water (surface tension: 72.75 dyne/cm) at 20° C.

By fitting this printing to a facsimile apparatus, a clean proof (a reproduction proof) of a newspaper including a half-tone picture of 85 lines/inch was copied, in which the apparatus was operated at a maximum output voltage of 80 volts and scanned with a stylus electrode of 0.15 mm in diameter, 10 g of stylus pressure, 100 m/minute of scanning rate and 10 lines/mm of line density.

The offset printing with this printing sheet as carried out using city water as the wetting water. As the result, at least 3,000 copies of clear prints were obtained and the half-tone picture was also completely reproduced.

EXAMPLE 3

Using the same corona discharge device as that in Example 1, a polypropylene sheet of 0.10 mm in thickness was treated four times at 3.6 amperes of the primary current to form a hydrophilic layer. The thus formed surface layer could be easily and uniformly wet by a test solution of 68 dyne/cm in surface tension at 20° C.

In the same manner as that in Example 1, parallel line images were formed on this printing plate material by laser irradiation, and offset printing was carried out likewise. As the result, a durability of at least 1,000 prints and an equivalent resolving power were observed.

What is claimed is:

1. A method for producing a planographic printing plate or sheet which is characterized in that the surface of an oleophilic body comprising an oleophilic resin is subjected to a corona discharge treatment to form a hydrophilic layer on said surface, wherein said olephilic resin is polybutadiene, said corono discharge is the discharge of a sinusoidial AC voltage of 3 kHz frequency and 15,000 volts at a current of 1.8 amps, and wherein not less than 0.05 milliwatt hour of discharge current is applied to each 1 $cm^2$ of the surface of said body, whereby the wettability of said surface is increased.

2. A method for producing a planographic printing plate or sheet which is characterized in that the surface of an oleophilic body comprising an oleophilic resin is subjected to a corona discharge treatment to form a hydrophilic layer on said surface, wherein said olephilic resin is polybutadiene, said corona discharge is the discharge of a sinusoidal AC voltage of 3 kHz frequency and 15,000 volts at a current of 3.6 amps, and wherein not less than 0.05 milliwatt hour of discharge current is applied to each 1 $cm^2$ of the surface of said body, whereby the wettability of said surface is increased.

* * * * *

UNITED STATES PATENT AND TRADEMARK OFFICE

CERTIFICATE OF CORRECTION

PATENT NO. : 4,036,136

DATED : July 19, 1977

INVENTOR(S) : Tohru Takagi

It is certified that error appears in the above-identified patent and that said Letters Patent are hereby corrected as shown below:

Under "Foreign Application Priority Data" read -- Mar. 18, 1974 Japan .... 49-29966 --.

Column 1, line 16, for "Fro" read -- For --.

line 68, for "rhe" read -- the --.

Column 4, line 38, for "tupe" read -- type --;
lines 59-61, delete "covered with synthetic ... this steel roll".

Column 5, line 12, for "revolving" read -- resolving --;
line 36, for "coper" read -- copper --;
line 41, for "wetting" read -- wetted --.

Column 6, line 4, for "as" read -- was --;
line 29, for "corono" read -- corona --.

Signed and Sealed this

Thirtieth Day of May 1978

[SEAL]

Attest:

RUTH C. MASON
Attesting Officer

LUTRELLE F. PARKER
Acting Commissioner of Patents and Trademarks